US005123532A

United States Patent [19]

Rau et al.

[11] Patent Number: 5,123,532

[45] Date of Patent: Jun. 23, 1992

[54] BOX WITH TOOL AND BIT HOLDERS HAVING A CAMMING TRAY

[75] Inventors: Georg Rau, Giengen-Hohenmemmingen; Werner Hitzler, Herbrechtingen; Gerhard Riess, Bachhagel-Burghagel, all of Fed. Rep. of Germany

[73] Assignee: Firma George KNOBLAUCH, Giengen/Brenz, Fed. Rep. of Germany

[21] Appl. No.: 710,526

[22] Filed: Jun. 4, 1991

[30] Foreign Application Priority Data

Jun. 19, 1990 [DE] Fed. Rep. of Germany ..... 4019486

[51] Int. Cl.[5] ..... B65D 85/20

[52] U.S. Cl. ..... 206/379; 206/45.13; 206/373; 312/DIG. 33

[58] Field of Search ..... 206/349, 372–374, 206/379, 45.13, 45.18; 312/DIG. 33

[56] References Cited

U.S. PATENT DOCUMENTS

| | | | |
|---|---|---|---|
| 1,488,456 | 3/1924 | Harper | 312/DIG. 33 |
| 2,042,693 | 6/1936 | Yamman | 312/DIG. 33 |
| 2,219,597 | 10/1940 | Lutz | 206/45.13 |
| 2,775,342 | 12/1956 | Smith | 206/379 |
| 3,086,645 | 4/1963 | Yount | 206/45.13 |
| 3,926,308 | 12/1975 | Sullivan | 206/372 X |
| 4,006,821 | 2/1977 | Sautter | 206/379 |
| 4,175,659 | 11/1979 | Horian et al. | 206/373 X |
| 4,285,556 | 8/1981 | Loeffel | 206/372 X |
| 4,598,822 | 7/1986 | Hemmings | 206/379 |
| 4,660,719 | 4/1987 | Peterson et al. | 206/379 |
| 4,934,530 | 6/1990 | Riess | 206/379 |

FOREIGN PATENT DOCUMENTS

| | | | |
|---|---|---|---|
| 695174 | 9/1964 | Canada | 206/379 |
| 256860 | 8/1926 | United Kingdom | 206/45.13 |

OTHER PUBLICATIONS

IBM Technical Disclosure Bulletin, vol. 20, No. 8, Jan. 1978.

*Primary Examiner*—Bryon P. Gehman

*Attorney, Agent, or Firm*—Herbert Dubno; Andrew M. Wilford

[57] ABSTRACT

A tool-parts storage box has a base having a floor, generally parallel front and back walls projecting upward from the floor, and generally parallel side walls bridging the front and back walls. A cover can pivot on the base about a cover axis between a closed position overlying the walls and an open position projecting upward from the cover axis. An insert provided with holders for some of the parts can pivot on the side walls about an insert axis generally parallel to but offset from the cover axis and pivotal between a down position nestled in the base and an up position standing up above the base. A link connected between the cover and the insert pivots the insert from the down position into the up position on pivoting of the cover from the closed to the open position. A tray provided with holders for others of the parts is pivoted on the insert about a tray axis generally parallel to and offset from the cover and insert axes. The insert axis lies between the tray and cover axes. At least one slide fixed in the base part and engageable with the tray cams the tray from a recessed position lying generally on the floor in the down position of the insert and closed position of the cover and a raised position in the up position of the insert and open position of the cover.

8 Claims, 3 Drawing Sheets

BOX WITH TOOL AND BIT HOLDERS HAVING A CAMMING TRAY

FIELD OF THE INVENTION

The present invention relates to a storage box. More particularly this invention concerns such a box used to hold a tool and bits for the tool.

BACKGROUND OF THE INVENTION

It is standard to provide a special storage box for a compound tool, for instance a drill or power screwdriver, and the bits that are used with it with a special insert that holds the bits and with holders for the tool or other parts. The insert is typically pivoted on the base part of the box and is connected via a link to the cover so that when the cover is pivoted into the open position the insert is pulled up to hold the inserts for easy access. In a standard arrangement the insert holds the hex bits or twist-drill bits for a power unit and chuck that is itself fitted in the bottom of the box.

The main disadvantage with this type of arrangement is that the insert still blocks and partly covers whatever is held in the bottom of the box. Thus even though the parts held by the insert are readily accessible in the open position of the box, the other parts are still somewhat blocked.

OBJECTS OF THE INVENTION

It is therefore an object of the present invention to provide an improved storage box for a tool and/or its parts.

Another object is the provision of such an improved storage box for a tool and/or its parts which overcomes the above-given disadvantages, that is which provides good access to all of the parts in the box when open.

SUMMARY OF THE INVENTION

A storage box for tool parts according to this invention has a base having a floor, generally parallel front and back walls projecting upward from the floor, and generally parallel side walls bridging the front and back walls and projecting upward from the floor. A cover can pivot on the base about a cover axis between a closed position overlying the front, back, and side walls and an open position projecting upward from the cover axis. An insert provided with holders for some of the parts can pivot on the side walls about an insert axis generally parallel to but offset from the cover axis and pivotal between a down position nestled in the base and an up position standing up above the base. A link connected between the cover and the insert pivots the insert from the down position into the up position on pivoting of the cover from the closed to the open position. A tray provided with holders for others of the parts is pivoted on the insert about a tray axis generally parallel to and offset from the cover and insert axes. The insert axis lies between the tray and cover axes. At least one slide fixed in the base part and engageable with the tray cams the tray from a recessed position lying generally on the floor in the down position of the insert and closed position of the cover and a raised position in the up position of the insert and open position of the cover.

Thus with this arrangement all of the parts are raised for easy access when the cover is open. The tray is lifted and slid forward along the guides so that the parts held in it are moved out from underneath the raised insert.

According to this invention in the down and recessed positions the insert and tray extend generally parallel to each other and to the floor. Furthermore in the up, raised, and open positions the axes all lie generally in a plane parallel to the floor.

The slide of this invention extends at an acute angle between 45° and 60° to the floor between same and the front wall. Furthermore the slide has two axially spaced parts each of which runs along a respective one of the side walls from the floor to the front wall. The tray has an angled front edge complementary to the slide.

In order that the box holds open, the front wall has a back surface and the tray has a front surface confronting and engageable with it and the tray axis moves on displacement of the insert between the down and up positions through a metastable position in which it lies with the insert axis in a plane parallel to the floor of the base. The distance between the tray axis and the back surface measured parallel to the plane is slightly less than the distance between the insert axis and the front surface and the tray axis lying above the plane in the up position. Thus there is a slight toggle action moving between the closed and open positions with slight elastic deformation of the parts of the box.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
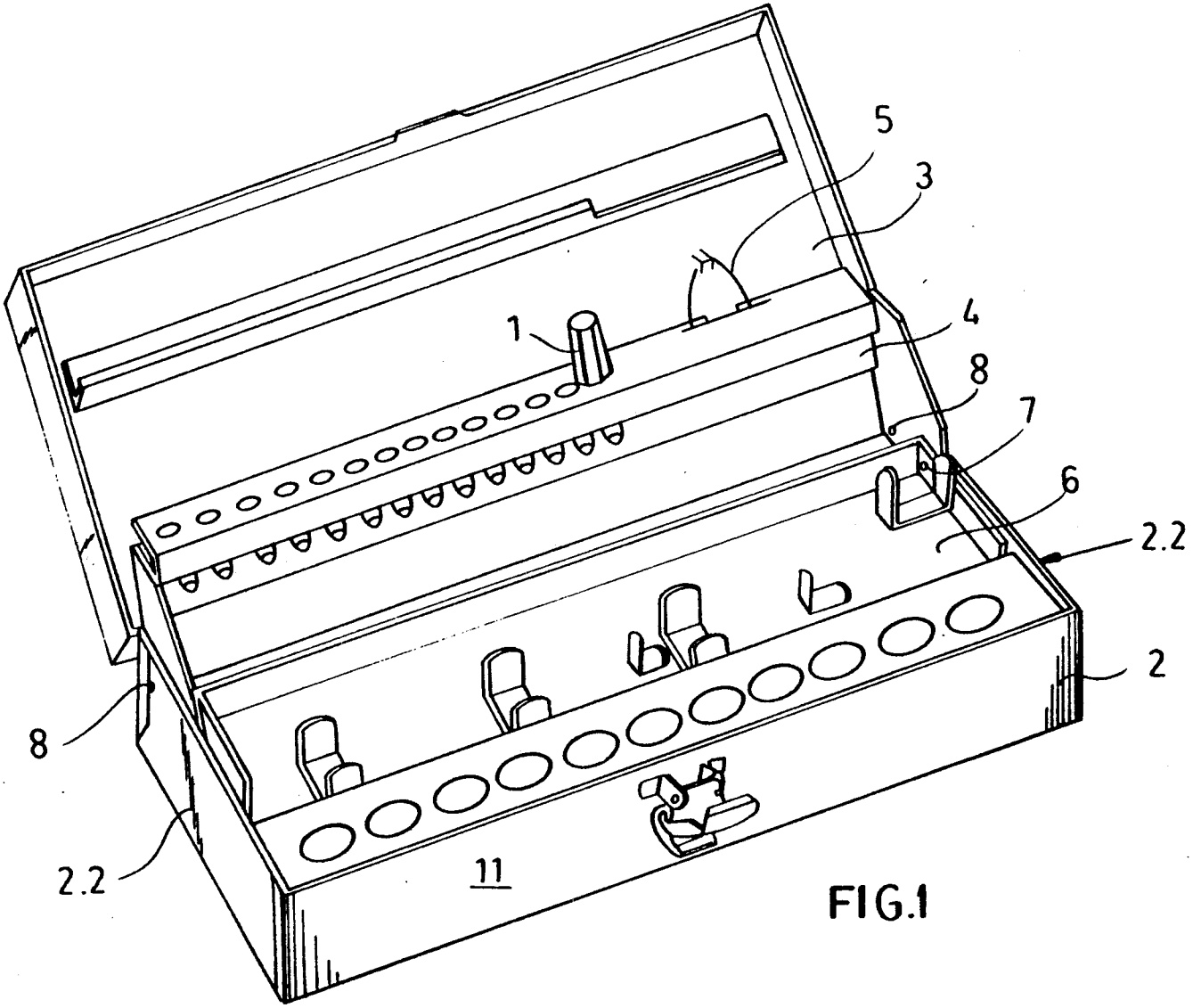
FIG. 1 is an isometric view of the box according to this invention when open.
Figure 2:
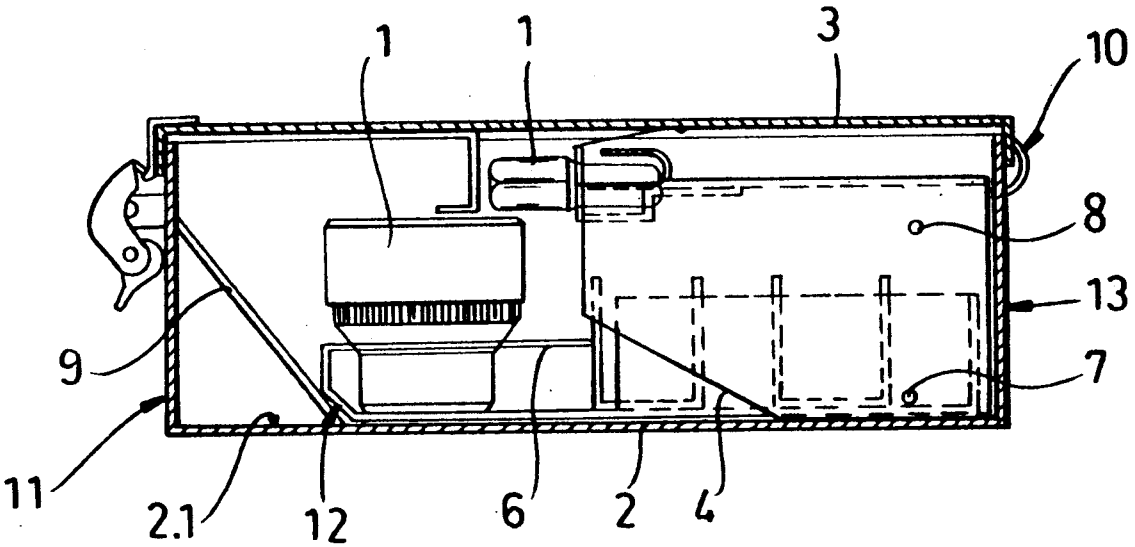
FIGS. 2 and 3 are cross sections through the box respectively when closed and open.
Figure 3:
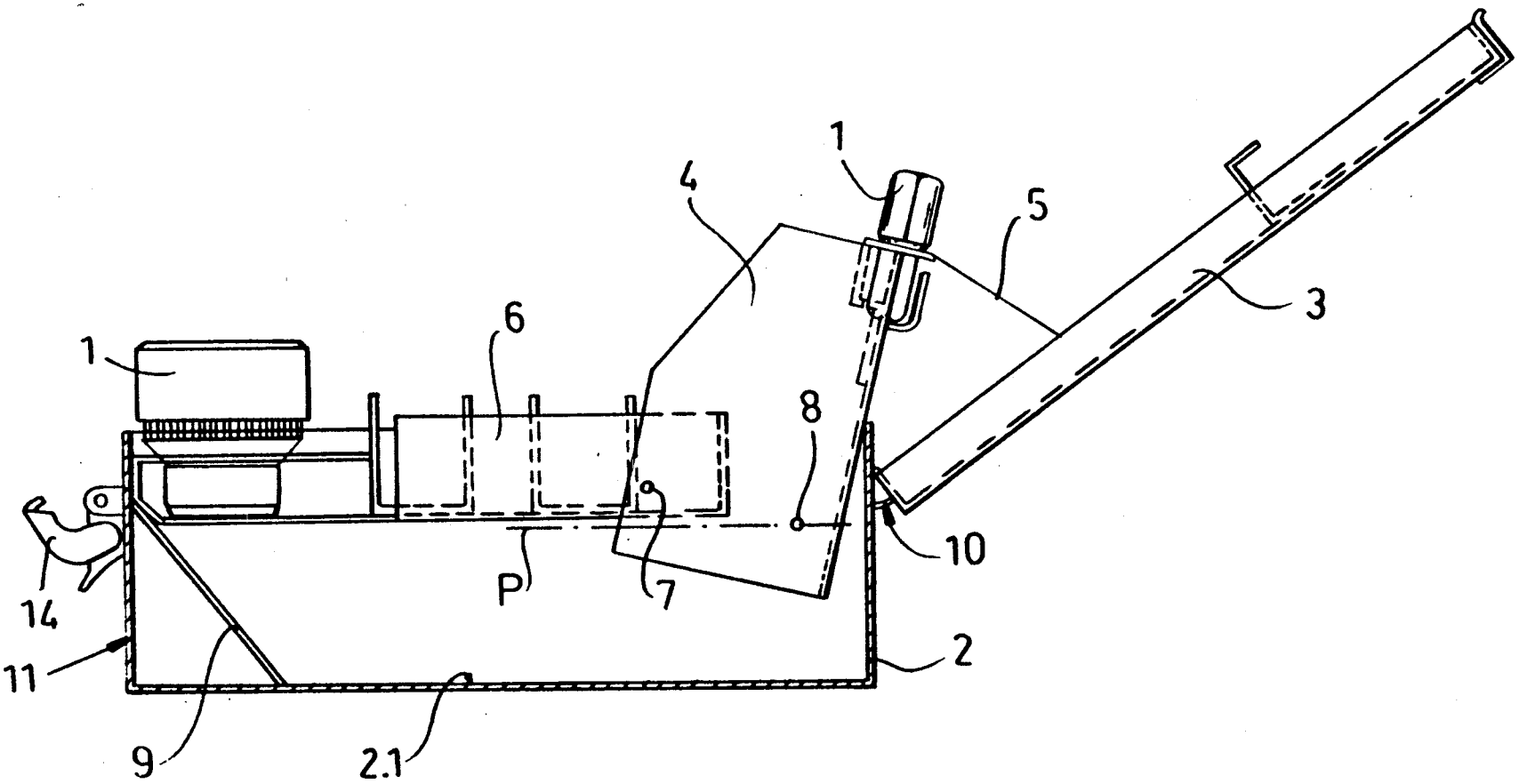

As seen in FIGS. 1 through 3 the storage box according to this invention has a parallepipedal sheet-metal base 2 and a rectangular cover 3. The base 2 has a planar and normally horizontal floor 2.1, upright side or end walls 2.2, and front and back walls 11 and 13 bridging the side walls 2.2. The cover 3 is pivoted on the back wall 13 at an axis 10. A catch 14 can secure the box shut.

An elongated insert 4 extending longitudinally between the end walls 2.2 is pivotal on the base 2 about a pivot axis 8 extending parallel to and adjacent the back wall 13. This axis 8 is in front of and slightly below the cover axis 10. The insert 4 is formed with holders for a row of bits 1. A link 5 has a front end pivoted on the insert 4 and a rear end on the cover 3 so that as the cover 3 is pivoted from the closed position of FIG. 2 to the open position of FIG. 3 the insert 4 is pulled by the links from the down position of FIG. 2 in which it lies wholly within the base 2 to the up position of FIG. 3 in which the bits 1 held by it are readily accessible. Reverse movement of the cover 3 pivots the insert 4 down to lay it flat on the floor 2.1.

According to this invention a holder tray 6 extending the full length of the box between its end walls 2.2 has a rear end pivoted at 7 on the insert 4 and a front end that is chamfered at 12 and that can ride on a pair of rails 9 that extend at an angle of about 52° upward from the floor 2.1 to the front wall 11 at each of the side walls 2.2. The axis 7 is parallel to the axes 8 and 10 and lies well below them in the FIG. 2 closed position. In the open position it lies slightly above the axis 8, that is above a plane P extending through this axis 8 and parallel to the floor 2.1.

In addition according to the invention the dimension of the tray 6 between the axis 7 and its front edge is slightly more than the distance measured parallel to the plane P from the axis 7 to the rear face of the front wall 11 when the axis 7 is level with the axis 8, that is when it is on the plane P parallel to the floor 2.1. Thus as the insert 4 is pivoted into the up position of FIG. 3 the tray 6 is first slid forward then up the rails 9 until it comes to rest against the back face of the wall 11, whereupon slight elastic deformation of the box occurs to hold the structure in the open position in which the axis 7 lies above the axis 8. The position in which both the axes 7 and 8 lie in the plane P is a metastable one so that the system holds in the open position.

We claim:

1. A storage box for a plurality of tool parts, the box comprising:

a base having a floor, generally parallel front and back walls projecting upward from the floor, and generally parallel side walls bridging the front and back walls and projecting upward from the floor;

a cover pivoted on the base about a cover axis between a closed position overlying the front, back, and side walls and an open position projecting upward from the cover axis;

an insert provided with holders for some of the parts and pivoted on the side walls about an insert axis generally parallel to but offset from the cover axis and pivotal between a down position nestled in the base and an up position standing up above the base;

means including a link connected between the cover and the insert for pivoting the insert from the down position into the up position on pivoting of the cover form the closed to the open position;

a flat tray provided with holders for others of the parts and pivoted on the insert about a tray axis generally parallel to and offset from the cover and insert axes, the insert axis lying between the tray and cover axes; and means including a slide fixed in the base and engageable with the tray for camming the tray from a recessed position lying generally flatly on the floor in the down position of the insert and closed position of the cover and a raised position in the up position of the insert and open position of the cover, the tray extending generally parallel to the floor but spaced therefrom in the raised position and lying further forward from the back wall in the raised position than in the recessed position.

2. The tool-part storage box defined in claim 1 wherein in the down position of the insert and recessed position of the tray the insert and tray extend generally parallel to each other and to the floor.

3. The tool-part storage box defined in claim 2 wherein the slide extends at an acute angle to the floor between same and the front wall.

4. The tool-part storage box defined in claim 3 wherein the acute angle is between 45° and 60°.

5. The tool-part storage box defined in claim 3 wherein the slide has two spaced parts spaced apart along the axes each slide part running along a respective one of the side walls from the floor to the front wall.

6. The tool-part storage box defined in claim 3 wherein the tray has an angled front edge complementary to the slide.

7. A storage box for a plurality of tool parts, the box comprising:

a base having a floor, generally parallel front and back walls projecting upward from the floor, and generally parallel side walls bridging the front and back walls and projecting upward from the floor;

a cover pivoted on the base about a cover axis between a closed position overlying the front, back, and side walls and an open position projecting upward from the cover axis;

an insert provided with holders for some of the parts and pivoted on the side walls about an insert axis generally parallel to but offset from the cover axis and pivotal between a down position nestled in the base and an up position standing up above the base;

means including a link connected between the cover and the insert for pivoting the insert from the down position into the up position on pivoting of the cover from the closed to the open position;

a tray provided with holders for others of the parts and pivoted on the insert about a tray axis generally parallel to and offset from the cover and insert axes, the insert axis lying between the tray and cover axes; and means includes a slide fixed in the base and engageable with the tray for camming the tray from a recessed position lying generally on the floor in the down position of the insert and closed position of the cover and a raised position in the up position of the insert and open position of the cover, the insert and tray extending generally parallel to each other and to the floor in the down position of the insert and recessed position of the tray, the front wall having a back surface and the tray having a front surface confronting and engageable with the back surface, the tray axis moving on displacement of the insert between its down and up positions through a metastable position in which it lies with the insert axis in a plane parallel t the floor of the base, the distance between the tray axis and the back surface measured parallel to the plane being slightly less than the distance between the insert axis and the front surface, the tray axis lying above the plane in the up position.

8. A storage box for a plurality of tool parts, the box comprising:

a base having a generally planar floor, generally parallel front and back walls projecting upward from the floor and generally parallel side walls bridging the front and back walls and projecting upward from the floor;

a cover pivoted on the base about a cover axis between a closed position overlying the front, back, and side walls and an open position projecting upward from the cover axis;

an insert provided with holders for some of the parts and pivoted on the side walls abut an insert axis generally parallel to but offset from the cover axis and from the floor, the insert being pivotal between a down position nestled int he base and an up position standing up above the base;

means including a link connected between the cover and the insert for pivoting the insert between the down position and the up position on pivoting of the over between the closed and the open position;

a tray provided with holders for others of the parts and pivoted on the insert about a tray axis generally parallel to and offset from the cover and insert axes, and insert axis lying between the tray and cover axes; and means including at least one slide fixed in the base and engageable with the tray for camming the tray from a recessed position lying generally on the floor in the down position of the insert and closed position of the cover and a raised position in the up position of the insert and open position of the cover, the tray axis lying further from the floor in the raised position than the insert axis in the up position.

* * * * *